United States Patent [19]

Davis et al.

[11] Patent Number: 4,603,730

[45] Date of Patent: Aug. 5, 1986

[54] MULTIPLE MODULE FURNACE SYSTEM

[75] Inventors: Esker K. Davis, La Canada; William F. Chew, Playa Del Rey, both of Calif.

[73] Assignee: GTI Corporation, San Diego, Calif.

[21] Appl. No.: 393,748

[22] Filed: Jun. 30, 1982

[51] Int. Cl.[4] ..... F27D 9/00

[52] U.S. Cl. ..... 165/30; 165/41; 165/61; 165/63; 165/64; 219/399; 219/390; 219/407; 373/136

[58] Field of Search ..... 165/14, 26, 30, 61, 165/63, 64; 219/390, 400, 406, 407, 531, 399; 373/110, 136

[56] References Cited

U.S. PATENT DOCUMENTS

| | | | |
|---|---|---|---|
| 1,930,836 | 10/1933 | D'Amico | 219/390 |
| 2,912,556 | 11/1959 | Hold | 165/30 |
| 2,994,514 | 8/1961 | Brown | 165/26 |
| 3,143,167 | 8/1964 | Vieth | 165/64 |
| 3,167,812 | 2/1965 | Bennigsen | 165/30 |
| 3,227,207 | 1/1966 | Litman | 165/30 |
| 3,393,729 | 7/1968 | Sauer | 165/61 |
| 3,933,434 | 1/1976 | Matovich | 219/390 |
| 4,156,454 | 5/1979 | Skala | 165/26 |
| 4,195,820 | 4/1980 | Berg | 219/390 |
| 4,246,955 | 1/1981 | Skala | 165/26 |
| 4,375,027 | 2/1983 | Zeto et al. | 219/390 |

*Primary Examiner*—Albert W. Davis, Jr.
*Attorney, Agent, or Firm*—Morland C. Fischer

[57] ABSTRACT

There is disclosed a multiple module furnace and system for aerospace application useful for conducting high temperature experiments and treatments of materials, particularly for alloying of metals. The furnace comprises a frame having a plurality of receptacles to receive a like plurality of furnace modules. Each furnace module has thermal insulation and thermal isolating means, an electrical resistance heater and a sample cavity which receives a plurality of sample containing crucibles. Each module is also provided with thermocouples at various locations to monitor and control the treatment. The system is highly autonomous and self-contained with its own supply of heat exchange and quench fluid and has a central programmable processor-sequencer to collect and store temperature, gravitational force, and time data, to control the time-temperature processing profile of each furnace module, preferably to maintain isothermal conditions throughout the furnace, by controlling the electrical heater and/or the supply of heat exchange and quench fluids for each module to cool or quench the samples according to a predetermined treatment, and to isolate the furnace from the other modules, the space capsule, and outer space.

10 Claims, 12 Drawing Figures

MULTIPLE MODULE FURNACE SYSTEM

BACKGROUND OF THE INVENTION

1. Field of the Invention

This invention relates to a furnace for high temperature treatment of a plurality of samples and, in particular, to such a furnace which can utilize the uniquely low gravitational forces experienced in aerospace applications.

2. Brief Statement of the Prior Art

It has been recognized that alloying of certain metals under very low gravitational forces could produce very beneficial results because of the elimination of convection forces and/or separations resulting from density differences in the molten metal which affect the alloying treatment. America's Space Shuttle provides an ideal platform for conducting the aforementioned high temperature treatment of metals and alloying elements since it can provide sufficient time at the low gravitational forces desired for significantly reducing the convection forces during preselected high temperature treatments of samples of metals and alloying elements.

The various alloys, however, require different treatments and, therefore, it is desired to provide a high temperature treatment system capable of selective treatment of each alloy or group of alloy metals at preselected and distinct conditions.

It is also desirable to automate the high temperature treatments of a plurality of alloying elements so that the various experiments can be automatically controlled without the necessity for intervention of an operator and thus avoid detracting the flight crews attention from more critical space flight operations. Furthermore, the Shuttle intervals of consistent, low-gravitational-force operation occur in varied time segments, e.g., in six to ten hour segments and the furnace system must be capable of performing its mission during several noncontiguous periods of time, preferably with initiation of each treatment cycle controlled by the flight crew.

It has been proposed that an automated system be designed to move samples of metals and alloying elements into and out of a single furnace which can be controlled to apply a preselected heating and cooling profile of the sample. However, this system has not succeeded, and one major obstacle has been the bulk and complexity of a suitable sample handling mechanism.

BRIEF DESCRIPTION OF THE INVENTION

This invention comprises a multiple module furnace and system for the high temperature treatment of a plurality of samples, particularly samples of metals and alloying elements. The system includes a support frame, which is preferably enclosed by a space-isolating chamber formed of low-temperature, radiant-energy insulation, and a plurality of receptacles, each receiving a furnace module. Each furnace module includes an outer, metallic tube that receives an inner, ceramic tube with the annular chamber therebetween filled with suitable insulation such as multi-layer insulation. The ceramic tube incorporates heating means in the form of an electrical resistance heater, preferably, a bifilar wound ribbon heater, temperature sensors such as thermocouples, and a sample cavity. One or more sample-containing crucibles are received in the sample cavity, positioned therein by a plurality of spacer fins on the outside wall of the crucible. Each furnace is provided with cooling means, including a distributor to direct a heat exchange fluid over the sample crucible and quench the sample and over the ceramic tube to provide a preselected furnace cool down cycle. Additionally, each furnace has outer cooling coils to circulate a heat exchange medium such as the coolant of the Shuttle, or other coolant, to isolate the module from surrounding modules and from the spacecraft.

The system includes a central, programmable processor-sequencer which receives temperature data from each furnace module, time data, preferably from its own separate-power-driven clock, and gravitational force data, from its own or the space craft's accelerometer. Data storage facilities, such as a tape recorder, are included. The processor-sequencer applies an autonomous, pre-selected time-temperature treatment to each furnace module, upon initiation by the flight crew. Upon completion of a treatment, the system automatically goes to a wait mode for a few minutes before proceeding to the next treatment, thus providing the crew with the opportunity to delay the treatment if the remaining time of the "quiet" or quiescent (low-gravitational force) period is not sufficient to complete the next treatment.

After the space craft lands, the furnace is recovered, the samples are removed and the stored data are read out and processed for delivery to the customer. The furnace system is then readied for reuse in future flights.

BRIEF DESCRIPTION OF THE FIGURES

The invention will be described with reference to the figures of which.

DESCRIPTION OF PREFERRED EMBODIMENTS

Figure 1:
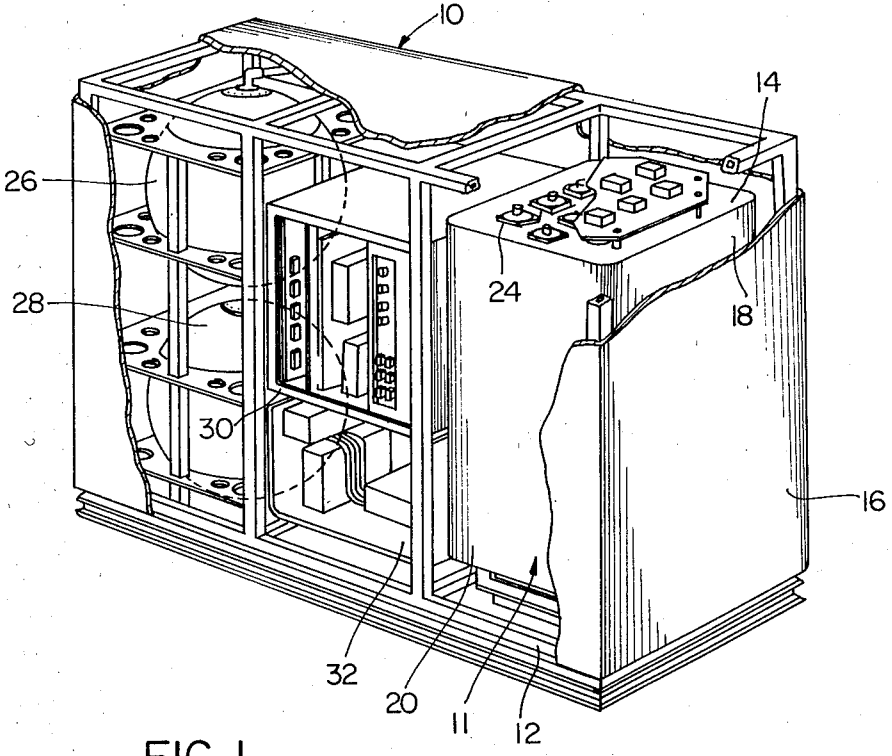
FIGS. 1 and 1*a* illustrate America's Space Shuttle.

Referring now to FIG. 1, the systems package 10 of the invention comprises a main frame 12 to structurally support the various components of the system and to provide means to secure the package in the spacecraft. The frame includes receptacle means, end wall 14 of housing 16, for receiving a plurality of furnace modules 24 used in the invention. Preferably, the housing 16 includes passive thermal blanket means such as side walls 18 and 20 which enclose the systems package 10. The side walls 18 and 20 as well as the end walls such as 14 of the housing 16 provide a passive thermal isolation of the furnace package from solar and deep space thermal environment. To this end, the side walls and end walls are formed of suitable low temperature insulating sheet material, e.g., multiple layer foil insulation which provides radiant energy reflectivity.

The main frame also structurally supports the heat exchange fluid reservoirs, canisters 26 and 28 and the various control and electrical systems sub-packages 30 and 32. Preferably, the entire package 10 constitutes a reuseable package which can be recharged and reprocessed for repeated use in shuttle flights.

Figure 1A:
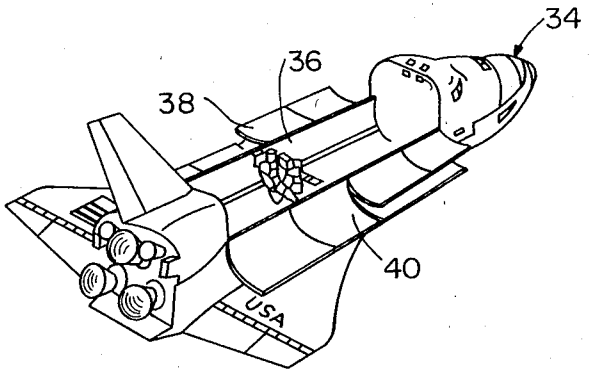

Referring now to FIG. 1*a*, the package 10 is illustrated as disposed in the Space Shuttle 34, within the cargo bay 36 of that space craft. Since the cargo bay is exposed to the solar and deep space environment when the bay doors 38 and 40 are opened, the thermal blanket design of housing 16 is desirable for isolating the package 10 and particularly, the furnace assembly 11 from this environment.

Figure 2:
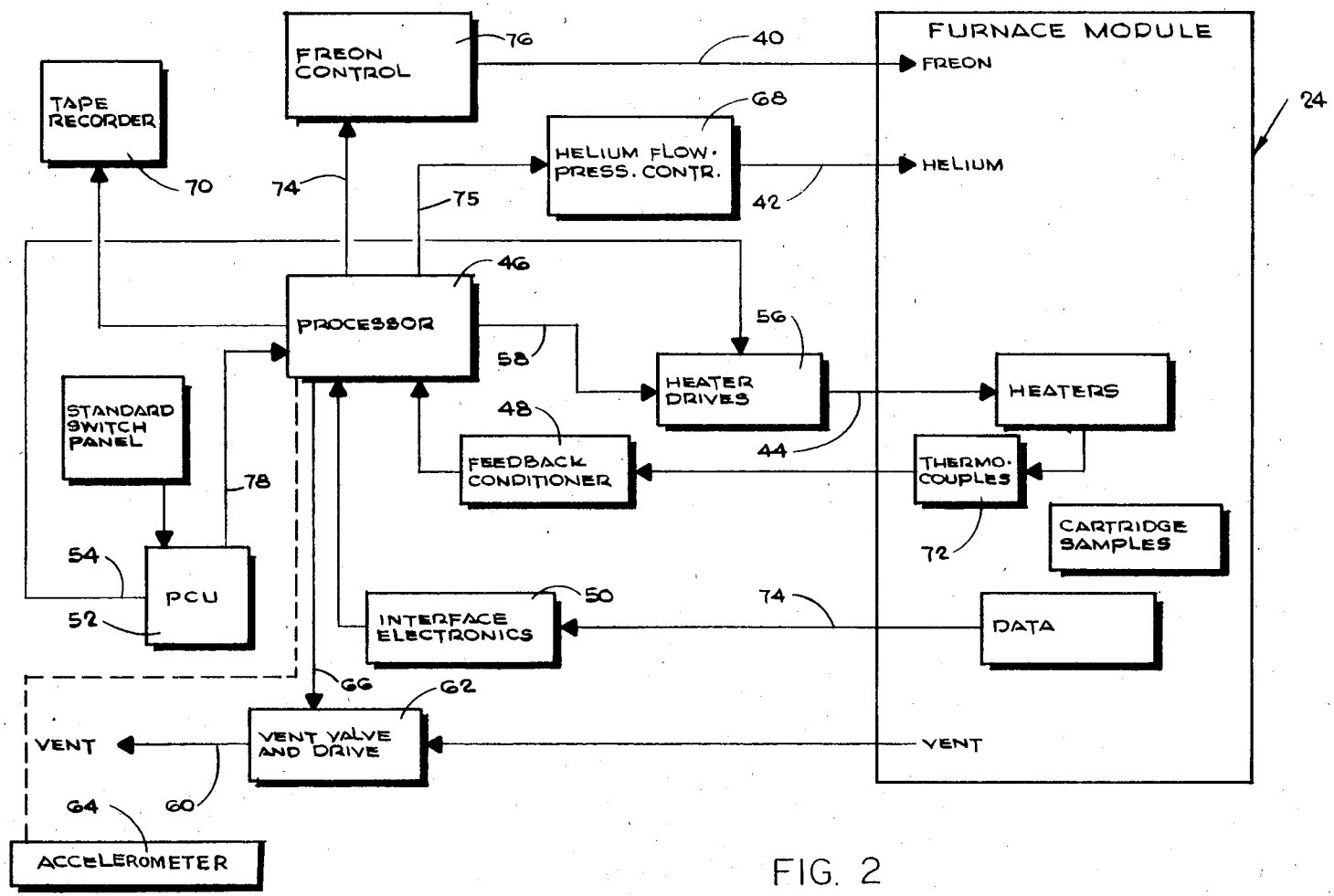
FIG. 2 is a block diagram of the electrical and control systems.

Referring now to FIG. 2, the electrical and control system is schematically shown. As there illustrated, the furnace module 24 receives a supply of freon coolant through supply line 40 and helium as a heat exchange and quenching fluid through line 42. Electrical power for activation of the electrical resistance heaters of the furnace is received through high voltage power lead 44. Each furnace module 24 contains at least one and preferably several thermocouples 72, as hereinafter described, and the temperature responsive signals transmitted by these thermocouples is fed to the microprocessor 46 through a feedback signal conditioner 48. The microprocessor control signals, in accordance with a pre-programmed time-temperature treatment profile for each selected furnace module, are applied to a preselected drive unit of the furnace heater drives 56 through lead 58, thus completing a temperature control loop. The feedback conditioner unit 48 is pre-programed for various signal conditioning, e.g., to amplify the temperature signals and reduce noise and increase stability of the microprocessor 46. The furnace module temperature signal data from the furnace module are also fed through lead 74 to an electronic interfacing system 50 and to the microprocessor 46. A suitable microprocessor is a Z80 which may be used with a 9511 arithmetic processing unit. The microprocessor is provided with its own internal clock that is preferably driven by its own, independent DC power supply contained within the processor unit 46.

The furnaces and the furnace system of the invention receive their power from the space craft's power source. Since this power source is variable, a power conditioning unit 52 is provided to condition and regulate the voltage of the power supply, and to provide a stepped-up, high voltage DC power which can be applied through high power bus 54 to the preselected furnace heater drive unit 56. Regulated and conditioned low voltage power is also supplied to the microprocessor through low voltage power lead 78. Alternatively, the system could have a battery supply for its low voltage power.

Each furnace module 24 is vented to space at preselected periods of its operating cycle through vent line 60 as controlled by the vent valve and drive unit 62 which is controlled by the microprocessor 46 through a low voltage DC signal applied through lead 66. The cooling and quench cycle of each furnace module is controlled by the microprocessor 46 by a low voltage DC signal applied through lead 75 to the control valve 68 in the helium coolant supply line 42 which directs a flow of helium into contact with the pre-selected furnace module 24 in a manner described hereinafter. Helium is a preferred heat exchange fluid because of its high conductivity and low molecular weight. The helium is stored for use in the system in the canisters 26 and 28, shown in FIG. 1.

The microprocessor 46 also provides a low voltage DC signal through lead 74 to operate a flow control valve 76 in the supply line 40 of a coolant, such as Freon, which is connected to cooling coils that surround each furnace module 24 to serve as a heat sink and thermally isolate these furnaces from the space craft and surrounding furnace modules as hereinafter described. The Freon can be obtained from the space craft, since it is used as the coolant for the space craft, or an independent Freon source and supply can be included in the system package 10 (of FIG. 1), if desired.

The microprocessor 46 also receives gravity or acceleration data. These data can be generated within the system package 10 by inclusion of a suitable accelerometer in the system or, if desired, can be accelerometer data generated by a space craft accelerometer 64. In either event, the signal is preferably furnished to the microprocessor 46. Data storage means, such as tape recorder 70, is provided to continuously record the gravitational force, temperature and time data which are all simultaneously passed to tape recorder 70 by microprocessor 46.

Figure 3:
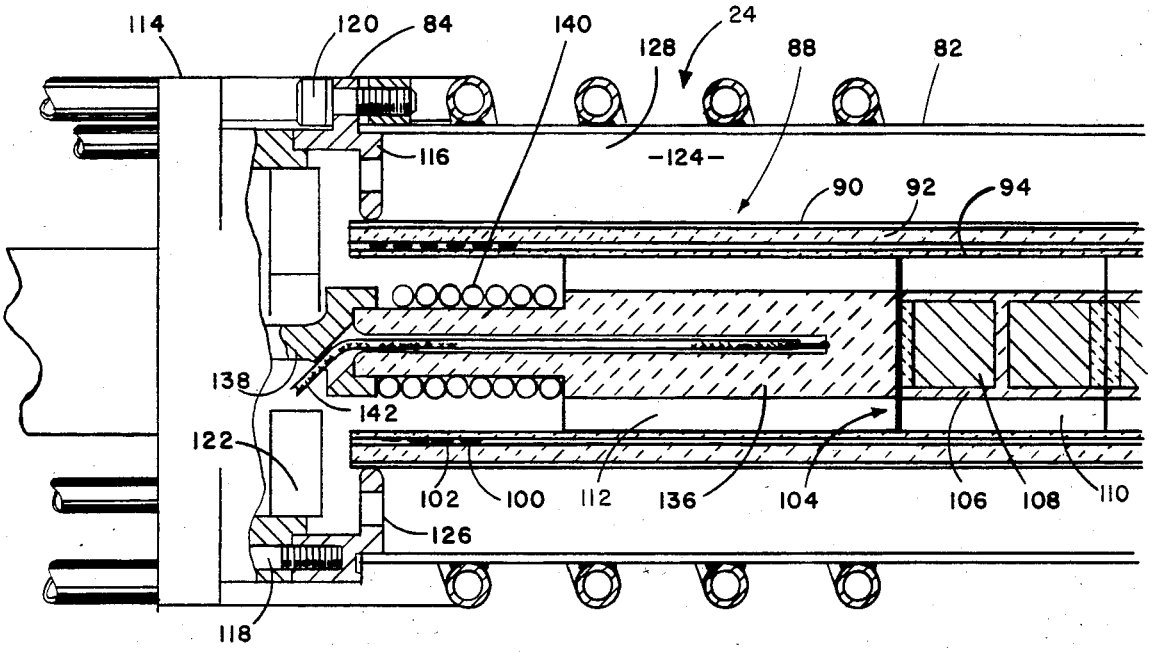
FIGS. 3 and 4 are cross sectional views of opposite ends of a furnace module.
Figure 4:
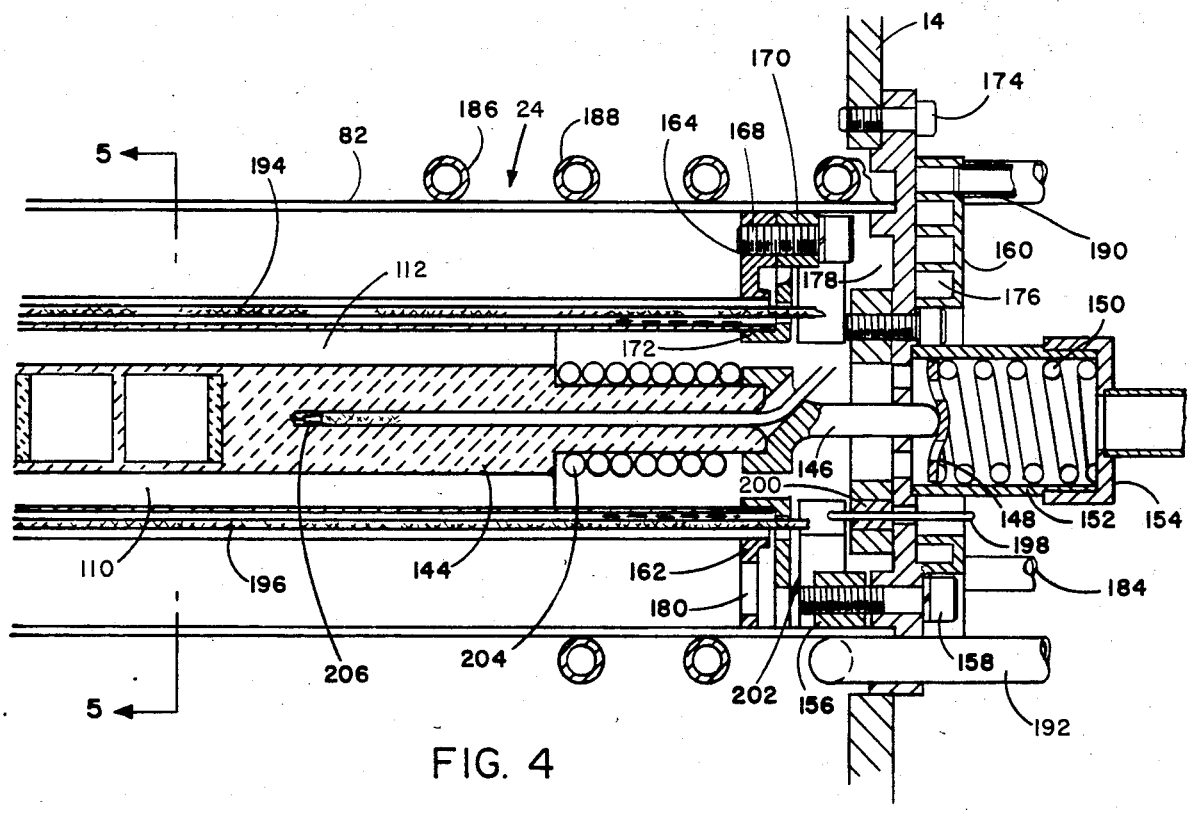
Figure 5:
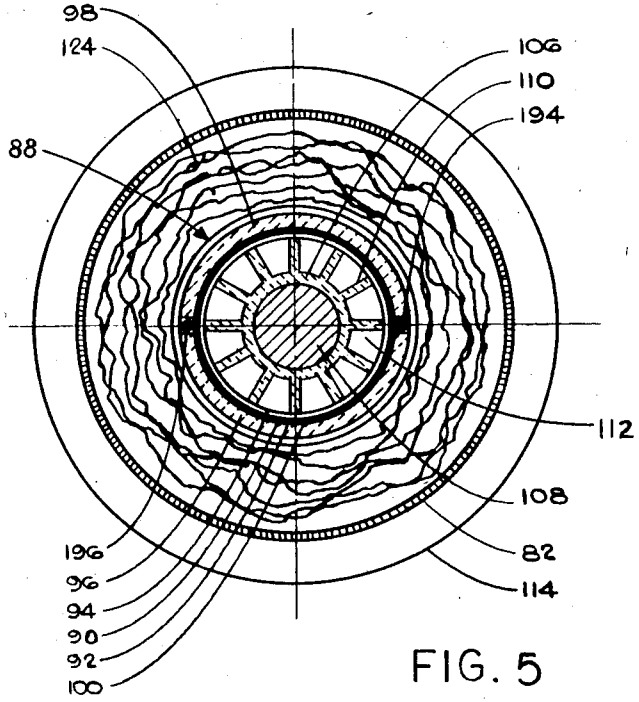
FIG. 5 is a cross sectional view along lines 5—5 of FIG. 4.

Referring now to FIGS. 3 through 6, the assembly of a typical furnace module will be described. Each system can include a plurality of these furnace modules, e.g., from 2 to about 100 modules, preferably from 5 to about 50 modules can be included in a system package. As shown in FIG. 3, each furnace module 24 comprises a cylindrical outer tube 82 having an end collar 84. This collar is permanently secured by welding to the cylindrical outer tube 82. A tubular furnace 88 is coaxially contained within the cylindrical outer tube 82. Each tubular furnace 88 comprises an outer metallic tube 90 and a pair of cylindrical ceramic tubes 92 and 94. As shown in FIG. 5, the outer cylindrical ceramic tube is actually formed by a pair of semi-cylindrical clam shells 96 and 98. The heating means of the furnace comprises an electrical resistance heater that is formed with a pair of ribbon heaters 100 and 102, preferably of tantalum which are helically bifilar wound about the inner ceramic tube 94. Preferably, the inner ceramic tube 94 has two continuous helical grooves which receive the flat ribbon heaters 100 and 102. The pair of ribbon heaters 100 and 102 are electrically connected to the high voltage conditioned DC power in a manner providing opposite direction current flow, i.e., either connected in series or if in parallel, with reverse polarity. This results in the resultant electromagnetic fields of the two windings being opposed so that a substantial portion of any electromagnetic field is cancelled.

The sample cavity 104 is contained within the tubular furnace 88. The samples are contained in crucibles 106 which are preferably in the form of tubular vials of suitable ceramic material in which are contained one or more samples of metals and alloying elements 108. Preferably, each crucible is of lesser outside diameter than the internal diameter of tubular furnace 88 and is coaxially oriented within the tubular furnace 88 by a plurality of spacers 110. As shown in FIG. 5, spacers 110 are positioned about the periphery of crucible 106 at random or, preferably, at equal angular spacings, typically providing from 4 to about 16 fins around each crucible. The fins also serve to provide an open, annular chamber 112 about each crucible 106 and, this annular chamber 112 receives the heat exchange and quenching fluid as hereinafter described. Other crucible configurations can be used; evacuated, sealed containers of refractory metals, with a suitable ceramic lining are useful. Also, selected applications may permit use of crucibles which entirely fill the sample cavity, e.g., when sample quenching by the helium gas flow is not necessary.

As shown in FIGS. 3 and 4, a plurality of sample crucibles 106 are assembled in each furnace module 24, in an end-to-end array, thereby extending the application of each module to a plurality of samples which are pre-selected to undergo a common time-temperature treatment profile. The actual number of crucibles so disposed in a single cavity can be varied considerably, from one to about 100 crucibles, preferably from 5 to about 35 crucibles can be provided in the cavity of a single module. In the assembly of crucibles, it is preferred to stagger the alignment of the spacer fins between the crucibles to increase the turbulence of gas flow and thus reduce its tendency to film flow across the fins and crucibles.

The ceramic used for the tubes of the furnace as well as the sample crucibles is preferably fired alumina, although quartz could also be used. The sample crucibles may also be enclosed in a metallic cylinder of a suitably corrosion resistant metal, e.g., stainless steel, particularly when the sample is anticipated to generate or release gases upon heating, e.g., when the sample contains oxides or oxide coatings. It is desired to enclosed the sample under these circumstances to avoid any danger of cross-contamination of the samples within the furnace module.

Each furnace module 24 is closed, at one end by end cap 114 which is secured to retainer ring 116 by machine bolts 118. Retainer ring 116 is, in turn, secured to the end collar 84 by machine screws 120. The end of the furnace assembly is also closed with suitable thermal insulation such as the insulating end washer 122. Retainer ring 116 is also provided with a plurality of orifices 126 communicating with the annular zone 128 between the outer and inner metal tubes 82 and 90, which is filled with annular sleeve 124 of thermal insulation.

The assembly of crucibles 106, in end-to-end array is secured within the tubular furnace 88 against axial movement by end core plug 136 which is restrained by an axial stop 138, which seats against an axial abutment, not shown. Any heat losses from the end of the modular furnace are compensated by the end heater 140 which comprises a winding of a suitable electrical resistance member and receives electrical power through cable 142.

Referring now to FIG. 4, the opposite end of the furnace module includes another end core plug 144 to axially restrain the assembly of sample crucibles 106. The end core plug 144 is restrained by the axial pin stop 146 which bears against an end plate 148 that is resiliently biased by a compression spring 150 contained within spring cylinder 152 and cap 154. This mounting provides a resilient accommodation for thermal expansion of the crucible assembly during the heating cycle.

The outer cylindrical tube 82 has a plurality of bosses 156 spaced about its inner periphery. These are tapped and internally threaded to receive machine screws 158 which extend through mating apertures of the end cover plate 160. The cylindrical furnace 88 distally carries mounting ring 162 which has internally threaded bores 164 to receive machine screws 168 that extend through an apertured bolt pattern in mounting ring 170 that is welded to the inside surface of the outer metallic tube 82. This ring 170 also has a circular lip 172 that is received in the open end of the cylindrical tubular furnace 88.

The furnace module 24 is bolted to the main frame such as plate 14 by machine screws 174 which extend through a bolt pattern in the periphery of the end cap 160 and into internally threaded apertures of the plate 14 of the main frame. The end cap 160 has a plurality of annular passageways 176 for distributing the flow of heat exchange fluid, such as helium, across its internal surface and to direct the flow into the inlet chamber 178, from where the helium can flow through apertures 180 of ring 162 into the annular zone 128 and can flow directly into the annular chamber 112 surrounding the center core assembly of face-to-face aligned sample crucibles 106. Cap 160 also has inlet and outlet conduits 182 and 184 (see FIG. 6) to receive and return the heat exchange and quench fluid flow from the reservoirs 26 and 28 (shown in FIG. 1).

The tubular furnace 88 is also provided with provision for a coolant flow such as Freon. This flow is provided through a pair of coils 186 and 188 which receive Freon flow from opposite ends of the assembly; the inlet of coil 188 appears as conduit 190 and the outlet of coil 186 appears as conduit 192 in FIG. 4.

FIG. 4 also illustrates the means for electrical connection to various thermocouples not shown located in the assembly. Preferably, at least two thermocouples are provided which extend to preselected intermediate lengths of the tubular furnace 88. The thermocouple leads 194 and 196 terminate in active thermocouple junctions (not shown) for sensing the temperatures at preselected point locations along the length of the tubular furnace 88. The leads 194 and 196 extend to the end of the assembly shown in FIG. 4 and each are connected to respective electrodes such as 198 which are mounted in the end cap with suitable electrical insulation 200. The end cap 160 is also thermally insulated by the end insulating washer 202 and has a thermal compensating heating coil 204 to compensate for heat losses through the end of the assembly, similar to the heating coil 140 at the opposite end, previously described with reference to FIG. 3. Another thermocouple 206 can also be provided in the end core plug 144 to monitor the temperature of this core and provide the necessary information for control of the heat supplied by the compensating heating coil 204.

Referring now to FIG. 5, the arrangement of the furnace components can be seen in greater detail. As there illustrated, the sample 108 is contained within the sample crucible 106 which is spaced from the inner metallic wall of the tubular ceramic furnace 88 by the spacer fins 110. The two thermocouple leads 194 and 196 are located between the opposed longitudinal edges of the two clam shell halves 96 and 98 of the outer ceramic tube 92, surrounding the inner ceramic tube 94 which carries the bifilar wound flat ribbon heaters. The annular space between the tubular furnace and the outer metal cylinder is filled with suitable insulation 124. A preferred insulation which is useful for this purpose is a multi-layer laminate which is commercially available for this purpose. This is a foil layer laminate of a refractory metal, molybdenum, which is impregnated with crystals of a refractory material such as zirconium oxide, that serve as spacers to provide an open packing of the metal sheets and thereby serve to provide a high temperature insulation composite. The same insulating material is used for the insulating end washers 122 and 202, previously described.

The outer cylindrical tube 82 is preferably formed of a magnetic nickel alloy so that when grounded it serves as a radio frequency shield to prevent the propagation of any radio frequency radiation from the assembly.

Figure 6:
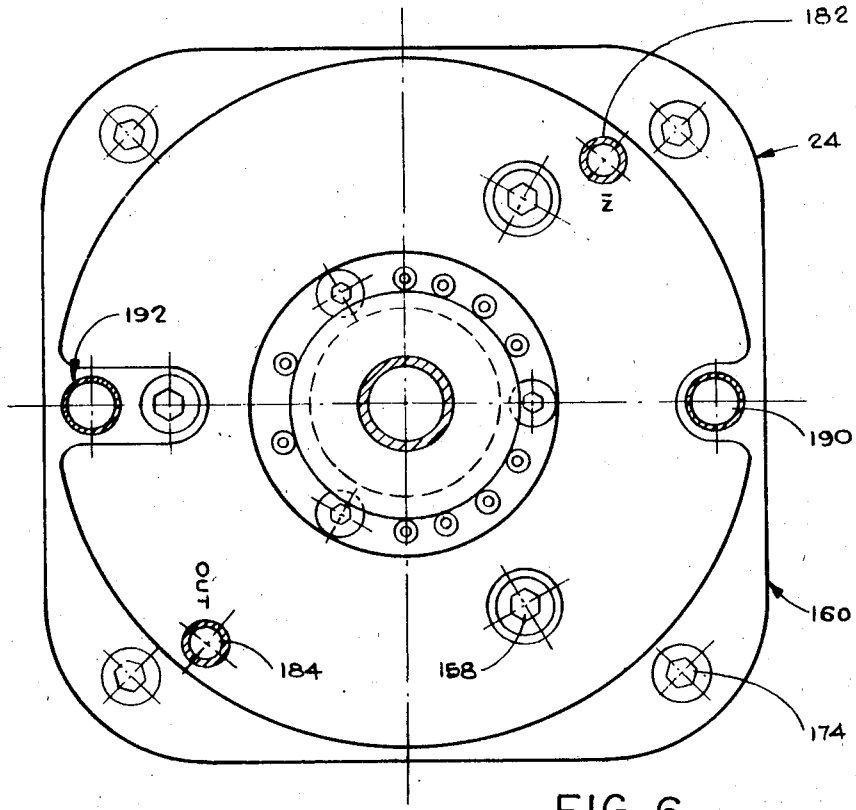
FIG. 6 is an end view of the furnace module.

Referring now to FIG. 6, the end plate 160 is shown bolted into the assembly by machine screws 158. The illustration also shows end plate 160 secured to the main frame by the mounting bolts 174. The conduits 190 and 192 which communicate with the cooling coils 188 and 186 (of FIG. 4), respectively, are shown in the illustration. The illustration also shows the inlet port 182 and outlet port 184 for the helium supplied to the end cap 160.

Figure 7:
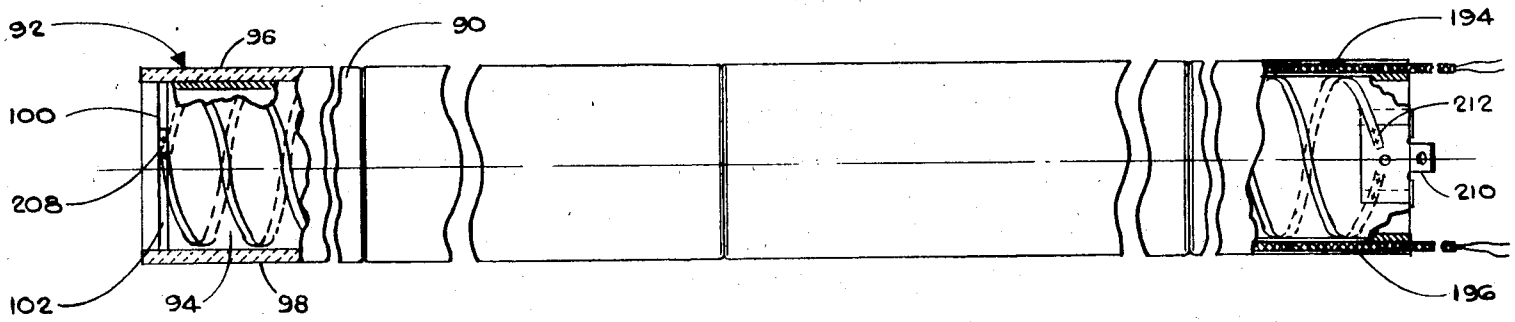
FIG. 7 is a partial cross sectional view of the ceramic tube furnace.

Referring now to FIG. 7, the construction of the tubular furnace will be described in greater detail. As there illustrated, the tubular furnace includes an inner cylindrical ceramic tube 94 which is provided with a pair of helical grooves coextensive its length. A pair of ribbon heaters 100 and 102 are placed in the continuous helical grooves to provide the bifilar winding about this inner ceramic tube 94. The two clam shell halves 96 and 98 of the outer ceramic tube 92 are positioned over the windings, completing this assembly which is then inserted into the inner metallic tube 90, shown in FIGS. 3 and 4. The ends of the two flat ribbons are electrically connected at common junction 208 at the left of the assembly and, at their opposite ends, are connected, each to a connector plate 210 by a electrical connection 212.

FIG. 7 also illustrates the leads 194 and 196 which extend to thermocouple junctions at preselected spaces along the length of the tubular furnace.

Figure 8:
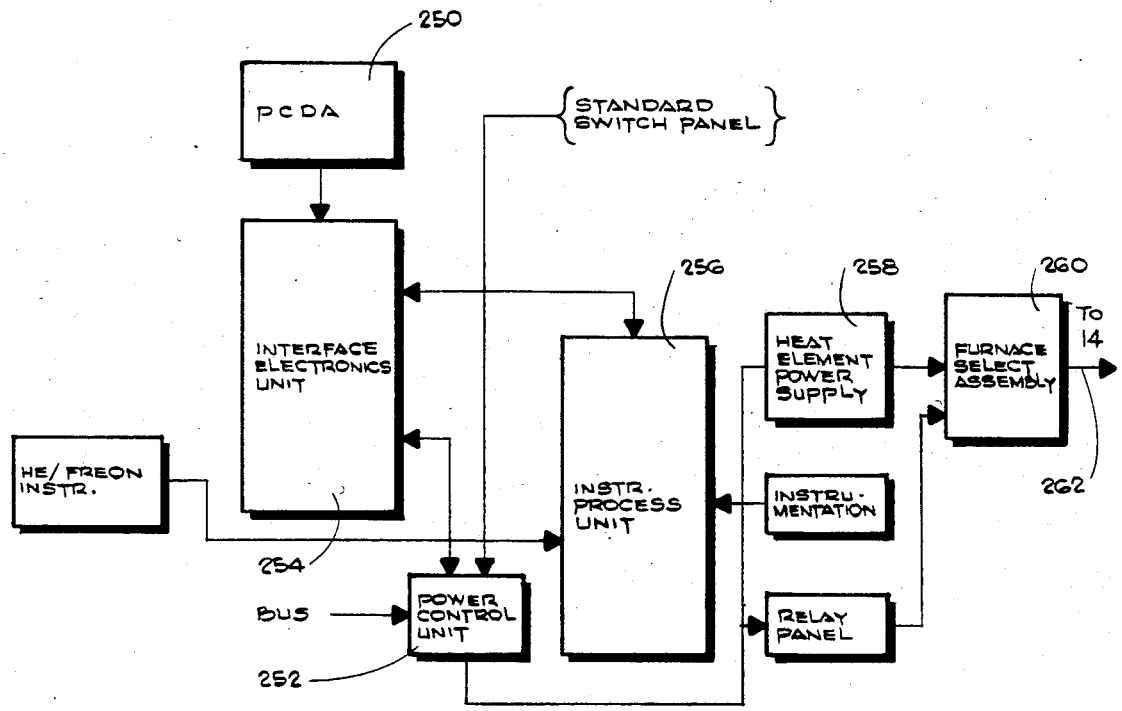
FIG.8 is a block diagram of the software and interfacing of the system.

Referring now to FIG. 8, the block diagram of the flight software interfaces is shown. The software performs its functions by executing predetermined sequences of tasks, each of which is a discrete module of code. Several tasks can be linked together in a unique sequence to form a treatment process. The operating system is a real-time, multi-tasking operating system which controls the software process. The operating system provides the following: a task scheduler which determines the order of task execution; an interrupt processor to service interrupts without loss of data from the suspended task; a priority scheme for task execution and interrupts; options for enabling a task, an input/output handling scheme; and a data base definition mechanism. The flight software comprises firmware in the process control and data acquisition unit 250 which interfaces with the power control unit 252, the interface electronics unit 254 and the instrument process unit 256. The software consists of a real time operating system in applications program and a data base. The power control unit controls the heater element power supply 258 through a furnace selection assembly 260 that preselects the appropriate one of the plurality of furnace modules 24 (of FIG. 1) generating the output power supplied to the module through conduit or bus 262.

Figure 9:
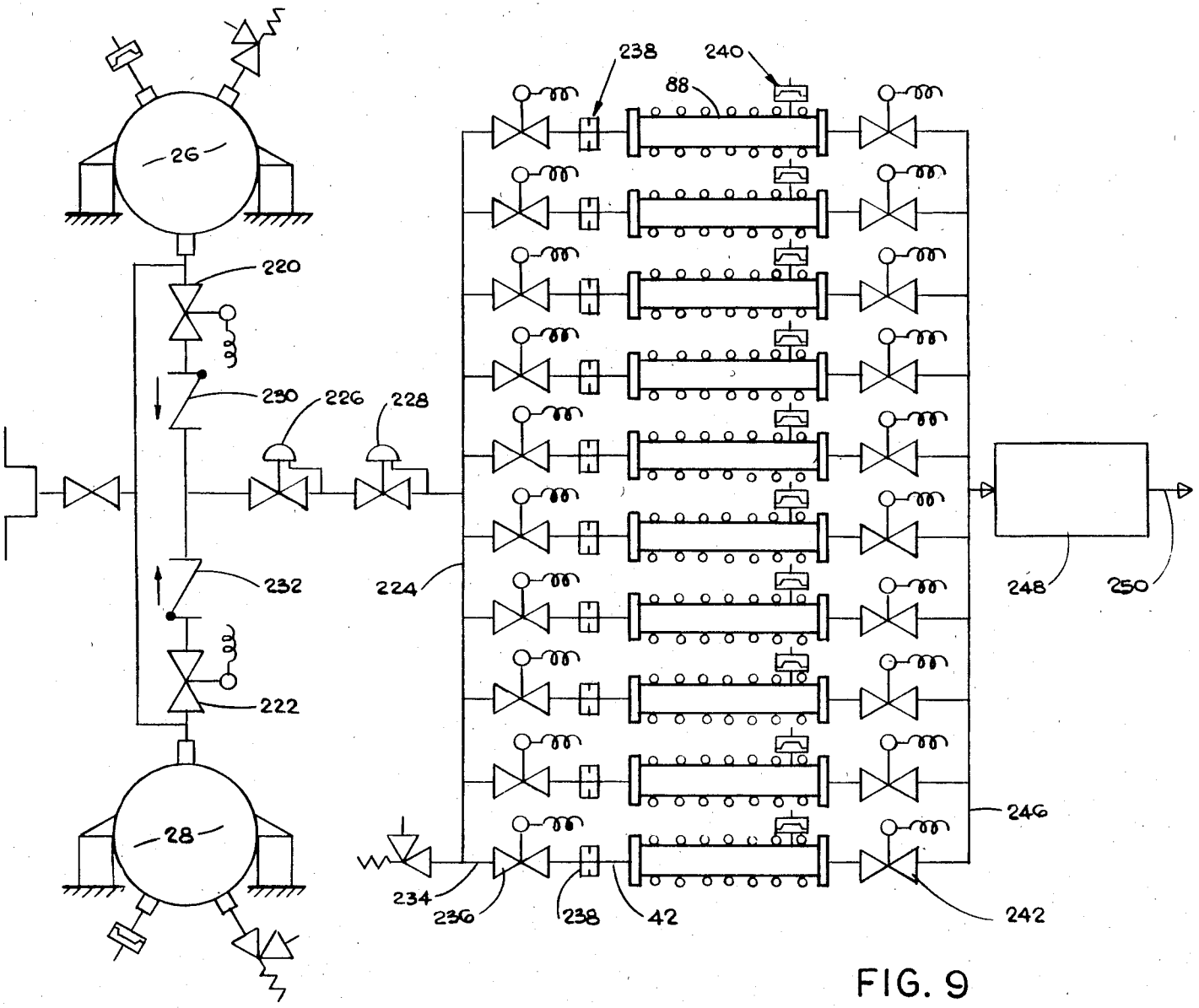
FIG. 9 is a schematic diagram of the heat exchange and quench fluid flow in the invention.

Referring now to FIG. 9, there is a schematic diagram of the flow system for the helium gas which is used as the heat exchange and quench fluid. The two reservoirs 26 and 28 are shown discharging through control valves 220 and 222 into a distribution header 224 through pressure regulator valves 226 and 228 which provide incremental drops in the gas pressure. Preferably check valves 230 and 232 are also provided for preventing any backflow into the reservoirs. The distribution header 224 discharges into a plurality of feeder conduits such as 234, each of which has its separate control valve 236 and a flow controlling orifice 238. The helium passageways of the furnace 88 are provided with a burst diaphragm safety valve 240 and the discharge of helium from the furnace is controlled by flow control valve 242 which discharges into a common exhaust header 246 and into a detrainment and condensor chamber 248 where any particulate matter or condensable material are collected. The chamber 248 discharges through a non-directional or bi-directional jet into space through conduit 250.

Figure 10:
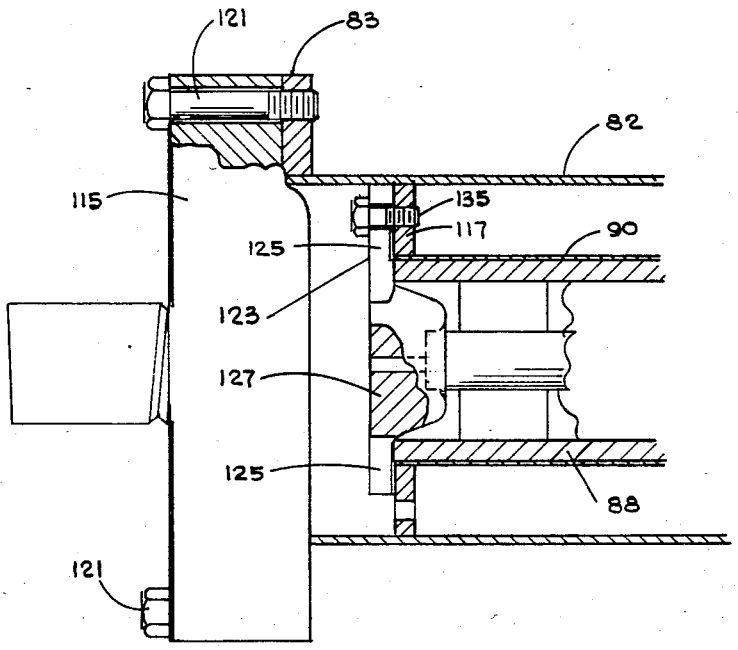
FIGS. 10 and 11 are cross sectional views of opposite ends of another furnace module.
Figure 11:
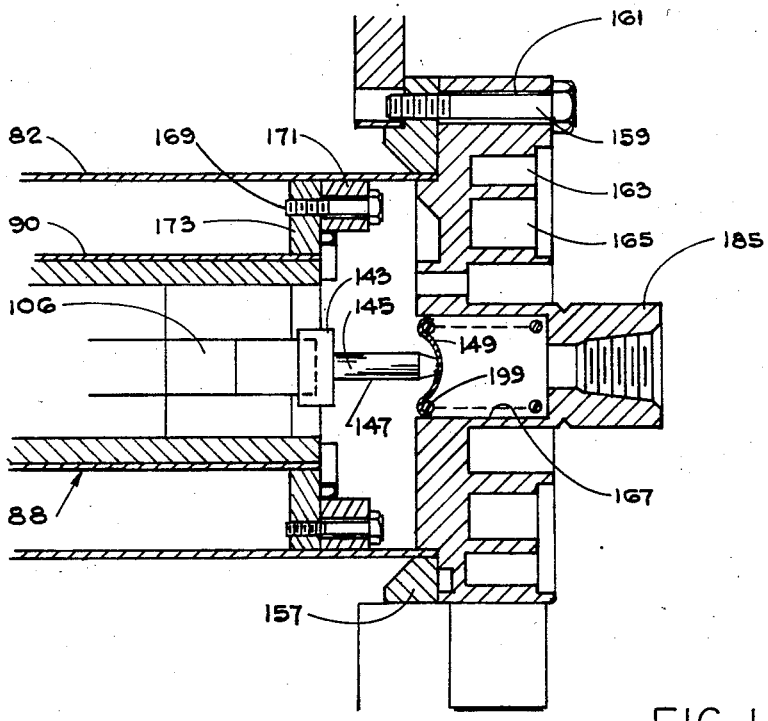

Referring now to FIGS. 10 and 11, a more preferred embodiment of the tubular furnace 88 is illustrated. As shown in FIG. 10, the outer metallic tube 82 has a collar 83 welded thereto which has a tapped and internally threaded bolt pattern to receive machine bolts 121 to secure the end plate 115. A spider 123 which has three legs 125 that are dependent from center hub 127 is slideably received in tube 82. Inner metallic tube 90 carries ring 117 which is welded thereto and which has threaded apertures to receive machine bolts 135 which extend through mating apertures in the legs of spider 123. These machine bolts 135 are threaded into the ring 117 to provide the proper axial position of the tubular furnace 88 and the proper tension on the compression spring, described hereinafter with regard to FIG. 11.

FIG. 11 illustrates the opposite end of the furnace module. The outer tube 82 has several bosses 171 about its inner wall which have apertures to receive machine bolts 169 which are threaded bores in end ring 173 that is welded to the end of inner metallic tube 90, thereby securing the end of the tubular furnace 88. The end of outer tube 82 carries ring 157 welded thereto, and this ring has a bolt pattern of threaded apertures to receive machine bolts 159 which secure end plate 161. The end plate has a plurality of annular grooves 163 and 165 which provide passageways for helium flow to cool the end plate 161, and a central cylindrical bore 167 which receives compression spring 199. The latter resiliently biases the assembly of the end-to-end array of sample crucibles 106. A core pin stop 147 is provided with a head 143 having a recess to receive the end of the last of the sample crucibles 106 and a shaft 145 which seats against a spring retainer plate 149. The helium supply to the furnace is provided by a sleeve adapter 185 which is threaded into central bore 167. The adapter is internally threaded with conventional pipe threads for attachment of the supply conduit 42 from the helium supply system. An identical end plate 115 is provided at the opposite end of the assembly, except the spring and retainer assembly is not used.

In operation, the system is activated once the space craft has entered a quiet period on constant, low-gravitational forces. The software is programed to carry out the treatment in each furnace module in a pre-selected sequence, under control of the central microprocessor-sequencer. The processing or treatment time for a single furnace module may be from 0.5 to about 20 hours, preferably from about 2 to about 8 hours. Since quiet periods in the Space Shuttle may come in periods of only six to eight hours duration, the furnace system is capable of carrying out its processing in noncontiguous periods. To this end, the software program automatically switches the system to a wait mode upon completion of a treatment process before commencing the next treatment process in the furnace module next in sequence. The wait mode can be of a pre-selected time duration, from 2 to 30 minutes, sufficient to alert the crew and provide them with the opportunity to put the system into a stop mode, in the event that the remaining time in the quiet period of the space craft is less than the next module's processing time. The furnaces are capable of conducting time-temperature treatment profiles up to 1500 degrees C. with temperature accuracies from plus/minus 2 degrees at the lower temperatures to a maximum deviation of plus/minus 5 degrees at the higher temperatures of this range. Each module is maintained at isothermal conditions, i.e., at a pre-selected constant temperature throughout the entire length of the sample cavity. Also, the controls of the system are sufficiently sensitive and precise that the samples within a module cavity can be maintained at a constant temperature for any desired time period, within the aforementioned temperature accuracies.

The furnaces are capable of heating rates sufficient to raise the sample temperature to the maximum within 15 to 45 minutes. The quench system is capable of cooling rates up to 400 degrees C. per minute to provide cooling times from 15 to 30 minutes.

Upon completion of the mission, the entire furnace package 10 can be removed from the space craft and returned to a processing center where the samples are removed for study and physical testing to obtain data which can be compared to that of control samples which were subjected to the same time-temperature treatment profile on earth. The stored flight treatment data can be readout from the data storage bank and assimilated in customer reports. The furnace package 10 can then be turned around by reloading the furnace cavity of each module with crucibles of new samples and by programing the software with the appropriate treatment conditions for the new samples.

The invention has been described with reference to the illustrated and presently preferred embodiments. It is not intended that the invention be duly unlimited by this disclosure of preferred embodiments. Instead, it is intended that the invention be defined by the means, and their obvious equivalents, set forth in the following claims.

What is claimed is:

1. A self-contained furnace module for heating a sample in outer space and a control system therefor, said furnace module and control system being secured to a furnace frame within a space flight vehicle and comprising:

furnace means for heating the sample, said furnace means having an outer protective tube and an inner heater carrying tube, each of said inner and outer tubes having a cylindrical configuration and being coaxially spaced relative to one another, thermal insulation disposed between said outer protective and inner heater carrying tubes, at least one crucible located within and spaced from said inner heater carrying tube of said furnace means for receiving therewithin the sample to be heated, a plurality of spacer means extending radially from said at least one crucible to said inner heater carrying tube so as to form fluid channels therebetween and provide heat exchange surfaces to dissipate heat developed at said crucible, means for supplying a cooling fluid surrounding the outer protective tube of said furnace module for providing thermal isolation of said module from the surrounding environment, means for supplying a heat exchange fluid to the fluid channels formed between said spacer means, heater means interfaced with said inner heater carrying tube for supplying heat to said crucible, power supply means for activating said heater means, sensing means interfaced with said heater means for supplying a signal that is indicative of the temperature developed by said heater means, signal processing means to receive the temperature indicating signal from said sensing means and control the respective operations of said cooling fluid supply means and said heat exchange fluid supply means, and feedback temperature control means interconnected between said signal processing means and said heater means for controlling the operation of said heater means and causing the heating of said furnace means to a particular predetermined temperature for a particular predetermined time.

2. The furnace module recited in claim 1, wherein said heater means comprises an electrical resistance heater.

3. The furnace module recited in claim 1, wherein said inner heater carrying tube of said furnace means includes helical grooves extending therealong, said heater means comprising ribbon heaters disposed within the helical grooves of said inner tube.

4. The furnace recited in claim 1, further comprising an end closure cooperating to maintain the spaced arrangement of said cylindrical outer protective tube, said cylindrical inner heater carrying tube, and said at least one crucible, said end closure having a plurality of passageways formed therein through which a supply of heat exchange fluid is supplied from the supply means thereof to an annular region formed between said cylindrical outer protective tube and said cylindrical inner heater carrying tube and to said fluid channels formed between said inner heat carrying tube and said at least one crucible.

5. The furnace module recited in claim 1, wherein one end of said furnace means includes support means interconnected with said at least one crucible, said furnace module further comprising resilient means interfaced with said support means to accommodate an axial movement of said crucible due to thermal expension.

6. The furnace module recited in claim 5, wherein said at least one crucible comprises a plurality of tubular vials aligned in an end-to-end relationship with one another, said resilient means moving said support means to receipt of the last of said crucibles, so as to maintain the end-to-end alignment thereof.

7. The furnace module recited in claim 1, wherein said cooling fluid supply means and said heat exchange fluid supply means are connected to said furnace frame.

8. A multiple furnace module system for heating one or more samples in outer space and including a main furnace frame located within a space flight vehicle and having receptacle means for receiving respective ones of said furnace modules, at least one of said furnace modules comprising:

a tubular outer protective jacket, a tubular inner furnace core arranged coaxially with and separated from said outer jacket by thermal-isolating insulation, heating means engaging the walls of said inner core and extending over at least a portion of the length of said inner core, at least one sample containing crucible means disposed within and arranged coaxially with said tubular inner core, a plurality of heat exchange elements extending radially from and arranged substantially coextensively along the length of said crucible means so as to provide heat exchange surfaces therefor, conduit means surrounding the outer protective jacket of said at least one furnace module for conveying a supply of cooling fluid and providing thermal isolation of said furnace module from other modules and from the space vehicle, fluid distribution means for conveying a source of heat exchange fluid between said crucible means and said tubular inner furnace core and past said heat exchange elements, and temperature control means interfaced with said heating means for causing the heating of said furnace module to a particular temperature.

9. The furnace module system recited in claim 8, wherein said at least one crucible means of said furnace module comprises an insulating vial having said plurality of exchange elements disposed thereabout to position said crucible means within said inner core.

10. The furnace module system recited in claim 8, wherein said furnace module includes at least one temperature sensing element embedded within said inner core and interfaced with said temperature control means for providing temperature information thereto.

* * * * *